US010984766B1

(12) United States Patent
Sands

(10) Patent No.: US 10,984,766 B1
(45) Date of Patent: Apr. 20, 2021

(54) SOUND GENERATION ANGULAR VELOCITY-ADJUSTABLE TWIRLING DEVICE

(71) Applicant: Krystian K. R. Sands, Brea, CA (US)

(72) Inventor: Krystian K. R. Sands, Brea, CA (US)

(73) Assignee: Krystian Sands, Brea, CA (US)

( * ) Notice: Subject to any disclaimer, the term of this patent is extended or adjusted under 35 U.S.C. 154(b) by 0 days.

(21) Appl. No.: 16/857,050

(22) Filed: Apr. 23, 2020

(51) Int. Cl.
*G10D 13/01* (2020.01)
*G10K 3/00* (2006.01)

(52) U.S. Cl.
CPC ..... *G10D 13/01* (2020.02); *G10K 3/00* (2013.01)

(58) Field of Classification Search
CPC ..... G10D 13/01; G10K 3/00
See application file for complete search history.

(56) References Cited

U.S. PATENT DOCUMENTS

2006/0160463 A1* 7/2006 Orr ..... G10G 7/00 446/236

* cited by examiner

*Primary Examiner* — Kimberly R Lockett
(74) *Attorney, Agent, or Firm* — Elizabeth Yang

(57) ABSTRACT

A sound generation angular velocity-adjustable twirling device detachably attaches to a fabric-article at a peripheral attachment point or a central attachment point and enables rotation of fabric-article. The fabric-article unfurls and twirls at a rate dependent on the center of gravity at different attachment points on fabric-article. A rod forms the central axis. A textured outer sleeve encapsulates the rod for secure grasping. A first axis positions in the outer sleeve, fixedly attaching to a first-rod end. A fastening mechanism rotates freely about the first axis while retaining the fabric-article. The rotating fastening mechanism and the stationary first axis form a rotational relationship with low friction coefficient. A second axis pins a strap to the second-rod end. The device generates sound while twirling through a gear assembly and/or percussion instruments. The sound generated is proportional to the angular velocity of the gear, and to the applied torque to the sleeve.

19 Claims, 12 Drawing Sheets

SOUND GENERATION ANGULAR VELOCITY-ADJUSTABLE TWIRLING DEVICE

FIELD OF THE INVENTION

The present invention generally relates to a sound generation angular velocity-adjustable twirling device. More so, the present invention relates to a twirling device that twists and twirls a fabric-article at a rate that is dependent on the center of gravity formed by varying the attachment points on the fabric-article and also dependent on the user who holds the twirling device to apply a rotating force thereon; and further simultaneously generates sound while twirling through use of a gear assembly and/or at least one percussion instrument, such that the angular velocity of the twirling device is proportional to the sound pressure generated by the gear assembly, the percussion instrument, and the twirling fabric-article.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

It is known that attendees at sporting events and rallies often demonstrate their affection or backing for a team, political figure, or performer by waving a pennant, flag, or rally towel having indicia such as slogans and colors symbolic of their partisanship. The pennant unfurls and twirls to attract attention and create a festive, supportive atmosphere.

However, pennants, flags, and rally towels are often cumbersome and tiring to twirl after a duration. The individual's arm gets tired of waving a towel that is loose and held by hand. Pennants associated with handles are often cumbersome, heavy, and tiring to spin. There is a need in the art of pennants, flags, and rally towels for an easier means to support and provide a longer lasting spin with less effort on the part of the user.

Additionally, while rotating the pennant, the pennant or towel often twists and curls onto itself, not permitting the colors of the sport teams to be readily shown or seen. There is thus a need to provide for a mechanism that permits the twirling of the pennant or towel with relative ease and in some instances without curling or twisting. A need is therefore felt to relieve fan's wrists of the strain caused by spinning and therefore allowing extended or more vigorous use.

It is known that the pennant or towel spins about a center of gravity, somewhere along the body of the pennant or towel. Generally, the center of gravity of a distribution of mass in space is the unique point where the weighted relative position of the distributed mass sums to zero or the point where if a force is applied causes it to move in the direction of force without rotation. The distribution of mass is balanced around the center of mass, and the average of the weighted position coordinates of the distributed mass defines its coordinates.

Generally, Sound is a vibration that typically propagates as an audible wave of pressure, through a transmission medium such as a gas, a liquid or a solid. Often, sound can be generated in a sporting event or rally to heighten the stimulus of the game or rally. This can include various types of noisemakers, including horns, clickers, bells, whistles, megaphones, and rattlers. The use of twirling pendants and noise-making devices provides both a visual and an audible stimulus for the game or rally.

Other proposals have involved devices for spinning pennants and towels. The problem with these spinning devices is that they do not enable the center of gravity of the pennant or flag to be changed, so as to create different unfurling and twirling effects. Also, the handle used to control the device is not easy to hold when rotating. Even though the above-cited spinning devices meet some of the needs of the market, a sound generation angular velocity-adjustable twirling device that detachably attaches to a fabric-article at a peripheral attachment point or a central attachment point, and enables rotation of the fabric-article, causing the fabric-article to unfurl, twist, and twirl at a rate and style that is dependent on the center of gravity formed from varying attachment points on the fabric-article, and further generates sound pressure through a gear assembly and at least one percussion instrument, is still desired.

SUMMARY

Illustrative embodiments of the disclosure are generally directed to a sound generation angular velocity-adjustable twirling device. The twirling device is configured to twist and twirl a fabric-article at a rate that is dependent on the center of gravity formed by varying the attachment points on the fabric article. The twirling device simultaneously generates sound while twirling through use of a gear assembly and/or at least one percussion instrument, such that the angular velocity of the twirling device is proportional to the sound pressure generated by the gear assembly, the percussion instrument, and the twirling fabric-article.

In some embodiments, the twirling device provides a freely rotating fastening mechanism that detachably attaches to a fabric-article at a central attachment point or a peripheral attachment point. The device enables rotation of the fabric-article, causing the fabric-article to twist and twirl at a rate that is dependent on the center of gravity formed by varying the attachment points on the fabric article. In one embodiment, a torque is applied to the device to unfurl and twirl the attached fabric-article, and the point of attachment between the device and the fabric-article forms a center of gravity that affects the rate and type of twirling by the fabric-article.

In some embodiments, the twirling device may include a rod that forms a central axis for the device. A textured or non-textured outer sleeve encapsulates the rod and enables a firm grasp of the twirling device. A first axis is fixedly disposed in the cavity of the outer sleeve, and embedded in a first-rod end of the rod. A distal end of the sleeve joins with a fastening mechanism.

The fastening mechanism may include a spring-based clip that detachably attaches to the fabric-article at a peripheral attachment point or a central attachment point to provide varying centers of gravity. The attachment point can quickly be changed to achieve a desired twirling and unfurling style.

The fastening mechanism attaches to the first axis with a pin. The fastening mechanism rotates freely about the first axis. The freely rotating fastening mechanism and the stationary first axis form a rotational relationship that has a low friction coefficient, so as to facilitate rotation of the fabric-article. This is because the fastening mechanism rotates freely about the first axis due in part to the first axis having an exterior cross-sectional length sized to correspond with an interior cross-sectional length of the fastening mechanism. In one embodiment, a tube serves receives the first axis, serving as a washer against the fastening mechanism.

In this manner, the rate, or angular velocity, of twirling, unfurling, or display of the fabric-article can be adjusted depending on the position of the fastening mechanism relative to the attachment point on the fabric article. Thus, by grasping the outer sleeve and twisting the wrist or arm, the fabric-article may be twirled in circles about the axis with relative ease and without curling or twisting of the fabric-article. A second axis serves to pin or staple a strap to a second-rod end of the rod. The strap can be used to hold the device around the wrist.

The twirling device also generates sound while twirling through use of a gear assembly, at least one percussion instrument, or the twirling fabric-article ruffling in the wind. The gear assembly is contained in a gear housing and comprises a second gear that is in meshed engagement, wherein the second gear can be shaped as a cogwheel having at least one gear engaged with other gears, wherein the cogwheel can be made of wood or plastic. The gear assembly is made of flexible material, such as polymer or wood. In other words, the gear assembly can be a rectangular flat piece which is made of polymers or another kind of materials, wherein the gear assembly is attached to the spring-based clip to engage with the cogwheel or gears, so as to generate sound effects. The material is not limited to polymer or wood. The spring-based clip is biased towards a closed position in which a pair of jaws close down on the selected attachment point at the fabric-article. The first gear rotates freely about the second axis, due in part to the second axis having an exterior cross-sectional length sized to correspond with an interior cross-sectional length of the hole of the first gear. The first gear and the second gear can be meshed to generate sound pressure while rotating about the second axis. The at least one percussion instrument generates sound through the movement of the twirling device as torque is applied to the outer sleeve. Also, the fabric-article generates sound pressure while twirling in the air. The angular velocity of the twirling device is proportional to the sound pressure generated by the gear assembly, the percussion instrument, and the twirling fabric-article.

In one aspect, a center of gravity adjustable fabric-article twirling device comprises a rod defined by a first-rod end and a second-rod end. The device may further include an outer sleeve defined by a sleeve distal end, a sleeve proximal end, and a sleeve sidewall forming a cavity. The device may further include a textured panel disposed on the sidewall of the outer sleeve. The device may further include a cap defined by a cap sidewall and a cap top wall forming an aperture, the cap configured to join with the sleeve distal end. In some embodiments, the device may further include a first axis defined by a pair of the first axis ends, and the first axis is disposed in the cavity of the outer sleeve.

The device further includes a fabric-article defined by a central attachment point and a peripheral attachment point. The fabric-article is configured to be resilient, so as to freely unfurl and twirl in correlation to rotation by the axis. The fabric-article has a center of gravity that can be varied through attachment with a fastening mechanism at the central or peripheral attachment points.

In some embodiments, the device may further include a fastening mechanism joined with the axis distal end of the axis, the fastening mechanism configured to detachably fasten to the fabric-article at the central attachment point, the peripheral attachment point, or both, the fastening mechanism further configured to retain the fabric-article in a generally vertical or horizontal orientation while the fabric-article unfurls and twirls.

The fastening mechanism is configured to rotate freely about the first axis, due in part to the fastening mechanism having an exterior cross-sectional length sized to correspond with an interior cross-sectional length of the first axis. In this manner, applying torque to the outer sleeve creates angular momentum that causes the fastening mechanism to rotate.

In this manner, the attachment point between the fastening mechanism and the selected attachment point at the fabric-article forms a center of gravity for the fabric-article. And thereby, the rate of unfurling and twirling by the fabric-article is dependent on the center of gravity. For example, when the fabric is attached at the center, there is more uniformity and thus faster rotation/angular velocity. And when attached at edge/periphery, there is less uniformity when twirling and thus slower rotation.

In some embodiments, the device may further include a strap configured to join with the second-rod end and the sleeve proximal end. The device further comprises a second axis that is defined by a pair of second axis ends is disposed in the cavity of the outer sleeve, opposite the first axis. The second axis is configured to at least partially penetrate the second-rod end, so as to help fasten the strap to the second-rod end.

In some embodiments, the device generates sound through the use of a gear assembly that joins with the second-rod end. The gear assembly comprises a gear housing containing a first gear and the second gear in meshed engagement. Rotational engagement between the first gear against the second gear generates sound pressure. This generated sound is, at least partially, a result of predetermined shaped and arranged teeth around the periphery of the gears.

In one aspect, the gear assembly can be a noise maker, and generally is a rectangular flat piece which is made of polymers or different kinds of materials. The gear assembly is contained in a gear housing or molded into the spring-based clip, wherein the gear assembly comprises a second gear that is in meshed engagement, wherein the second gear can be shaped as a cogwheel having at least one gear engaged with other gears, wherein the cogwheel can be made of wood or plastic. The gear assembly is made of flexible material, such as polymer or wood. The material is not limited to polymer or wood. The spring-based clip is biased towards a closed position in which a pair of jaws close down on the selected attachment point at the fabric-article.

The first gear forms a hole that receives the second axis. The first gear rotates freely about the second gear, due in part to the second gear having an exterior cross-sectional length sized to correspond with an interior cross-sectional length of the hole of the first gear. Thus, applying torque to the outer sleeve causes the first gear to rotate about the second gear. And the sound pressure generated by meshing the first and second gears is proportional to the angular velocity of the rotating first gear.

In other embodiments, the device generates sound through the use of at least one percussion instrument. The percussion instrument attaches to the handle, the strap, or to the fastening mechanism, or both. Applying torque to the outer sleeve causes the percussion instrument to generate sound pressure. And the sound pressure generated by the percussion instrument is proportional to the angular velocity of the rotating fastening mechanism.

In another aspect, the outer sleeve has a generally elongated, cylindrical shape.

In another aspect, the textured panel comprises a grip-textured surface.

In another aspect, the first axis passes through the aperture in the cap top wall.

In another aspect, the device further comprises a pin that fastens the fastening mechanism to one of the pair of the first axis ends.

In another aspect, the fabric-article includes at least one of the following: a towel, a flag, a pennant, a sock, a shirt, and an advertising medium.

In another aspect, the fastening mechanism is configured to retain the fabric-article in a generally 90° angle relative to the outer sleeve.

In another aspect, the fastening mechanism is a spring-based clip.

In another aspect, the device further comprises a strap.

In another aspect, the strap configured to join with the sleeve proximal end.

In another aspect, the strap configured to enable wrapping around the wrist.

In another aspect, the first and second gears have irregularly or rectangular shaped teeth that are arranged in different configurations around the periphery of the gears.

In another aspect, the percussion instrument is a bell and a rattle.

In another aspect, a rattle support platform and a fastener support the rattle on the fastening mechanism.

One objective of the present invention is to unfurl and twirl a fabric-article, such as a towel or a pennant, with a freely rotating twirling device controlled by the hand, while simultaneously generating sound pressure through a gear assembly and at least one percussion instrument.

Another objective is to relieve the wrists from the strain caused by spinning and therefore allowing extended or more vigorous twirling of the fabric-article.

Another objective is to alter the center of gravity of the fabric-article by clipping the fabric-article at a central attachment point, or a peripheral attachment point, or both.

Yet another objective is to provide an easily detachable fastening mechanism, such as a spring-based clip, to enable adjustable attachment with the fabric-article.

Yet another objective is to provide a firm grip while twirling the device with a textured panel or non-textured panel on the outer sleeve.

Yet another objective is to attach the twirling device to the wrist with a strap.

Yet another objective is to provide an inexpensive to manufacture twirling device.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which:

FIG. 1I illustrates a top view of various types of second gears having a plurality of irregularly shaped and arranged teeth, in accordance with an embodiment of the present invention;

Like reference numerals refer to like parts throughout the various views of the drawings.

DETAILED DESCRIPTION OF THE INVENTION

Figure 1:
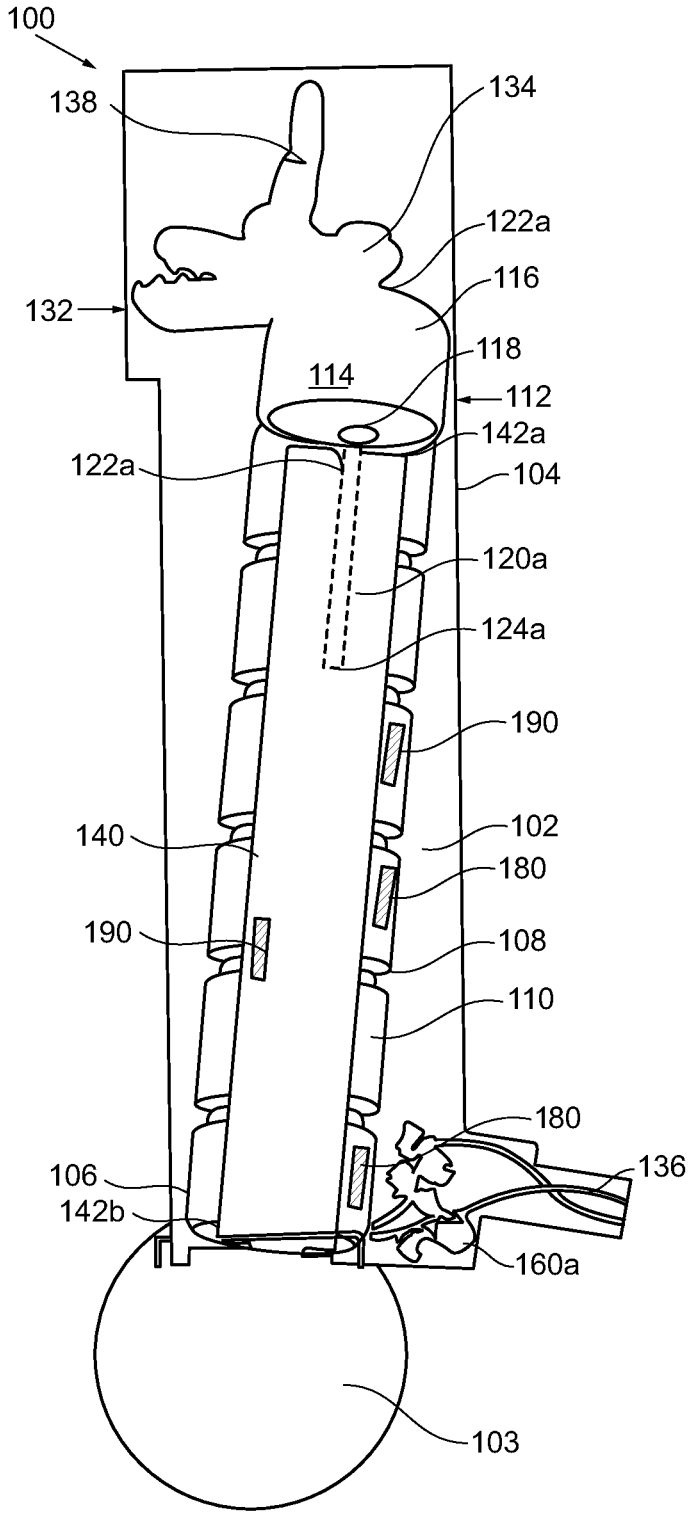
FIG. 1 illustrates a sectioned view of an exemplary sound generation angular velocity-adjustable twirling device, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting unless the claims expressly state otherwise.

A sound generation angular velocity-adjustable twirling device 100 is referenced in FIGS. 1-9. The sound generation angular velocity-adjustable twirling device 100, hereafter "device 100" is configured to enable facilitated twirling of a fabric-article 126 at different rates of unfurling and twirling while simultaneously generating sound pressure through at least one percussion instrument 160*a*, 160*b*. The generated sound level is proportional to the angular velocity of rotation by the device 100.

The technique used to unfurl and twirl is based partially on an amount of torque 200 applied to the device 100, and partially on the point of attachment on the fabric-article 126, which creates a center of gravity 202 that affects the unfurling and twirling thereof. The device 100 simultaneously generates sound while twirling through use of a gear assembly and/or at least one percussion instrument 160*a-b*, such that the angular velocity of the twirling device 100 is proportional to the sound pressure generated by the gear assembly 150, the percussion instrument 160*a-b*, and the twirling fabric-article 126.

In one embodiment, the device 100 provides a freely rotating fastening mechanism 132 that detachably attaches to a fabric-article 126 at a central attachment point 128 or a peripheral attachment point 130. The device 100 enables controlled rotational twirling of the fabric-article 126 through the application of torque 200. The attachment point between the fastening mechanism 132 and the fabric-article 126 is operable, so as to cause the fabric-article 126 to unfurl and twirl at a rate that is dependent on the center of gravity 202 formed by manipulating the fastening mechanism 132 to vary the attachment points 128, 130 on the fabric-article 126.

The device 100 is unique in that when a torque 200 is applied to an outer sleeve 102, the fastening mechanism 132 rotates freely about a first axis 120*a*, causing the attached fabric-article 126 to unfurl and twirl. Thus, angular momentum is generated on the device 100 through the application of torque 200. Further, the various point of attachments 128, 130 on the fabric-article 126 form different centers of gravity 202 within the fabric-article 126 that affects the rate and type of unfurling and twirling. This is possible due to the average location of the weight of the fabric-article 126 varying and being quickly adjustable through a quick-release attachment and detachment by the fastening mechanism 132 with the central and peripheral point of attachments 128, 130 on the fabric-article 126.

In one exemplary use of the device 100, attendees at sporting events and rallies can demonstrate their affection or backing for a team, political figure, or performer by waving the device 100, including an attached fabric-article 126, such as towels, flags, signs, and pennants. These pennant articles may comprise indicia such as slogans and colors symbolic of attendee's partisanship. The fabric-article 126 unfurls and twirls to attract attention and create a festive, supportive atmosphere.

As referenced in FIG. 1, the twirling device 100 may include a rod 140 defined by a first-rod end 142*a* and a second-rod end 142*b*. The first-rod end 142*a* may also include a hole, through which a first axis 120*a* penetrates in a fixed disposition, as discussed below. In one embodiment, the rod 140 is an elongated, cylindrically-shaped wooden dowel or a polymer-made elongated rod. Though in other embodiments, the rod 140 may take other elongated forms and be fabricated from materials, including polymers, metal, fiberglass, and rubber.

In some embodiments, a textured outer sleeve 102 encapsulates the rod 140. The textured outer sleeve 102 enables a firm grasp of the twirling device 100. A first axis 120*a* is disposed in the cavity of the outer sleeve 102. The first axis 120*a* is defined by a pair of the first axis ends 122*a*, 124*a*. The first axis 120*a* positions, at least in part, within the cavity of the outer sleeve 102, while one of the axis ends 124*a* penetrates the first-rod end 142*a*, or in some embodiments, a hole in the first-rod end 142*a*. In one embodiment, the first axis 120*a* is a polymer nail. Though in other embodiments, any elongated pin-like component may be used for the first axis 120*a*.

The first axis 120*a* also joins with a fastening mechanism 132. The fastening mechanism 132 rotates freely about the first axis 120*a*. The fastening mechanism 132 also serves to detachably attach to the fabric-article 126 at a peripheral attachment point 130 or a central attachment point 128 to provide varying centers of gravity 202 along the fabric-article 126.

In one embodiment, a tube 144 may be utilized to receive the first axis; and thereby serve as a washer to facilitate rotation of the fastening mechanism 132 about the first axis 120*a*. In this embodiment, the fastening mechanism 132 engages the tube 144, and the tube encapsulates the first axis 120*a*. The tube may include a cylindrical nylon sleeve. The tube 144 reduces the friction between the fastening mechanism 132 and the first axis 120*a*.

The first axis 120*a* and the fastening mechanism 132 form a rotational relationship that has a low friction coefficient, so as to facilitate rotation of the fabric-article 126. This is because the fastening mechanism 132 rotates freely about the first axis 120*a* due in part to the first axis 120*a* having an exterior cross-sectional length 204 sized to correspond with an interior cross-sectional length 206 of the fastening mechanism 132.

In this manner, the rate of twirling, unfurling, or display of the fabric-article 126 can be adjusted depending on the position of the fastening mechanism 132 relatives to the attachment point on the fabric-article 126. Thus, by gripping the outer sleeve 102 and twisting the wrist or arm, the fabric-article 126 may be twirled in circles about the first axis 120*a* with relative ease and without curling or twisting of the fabric-article 126.

Figure 2:
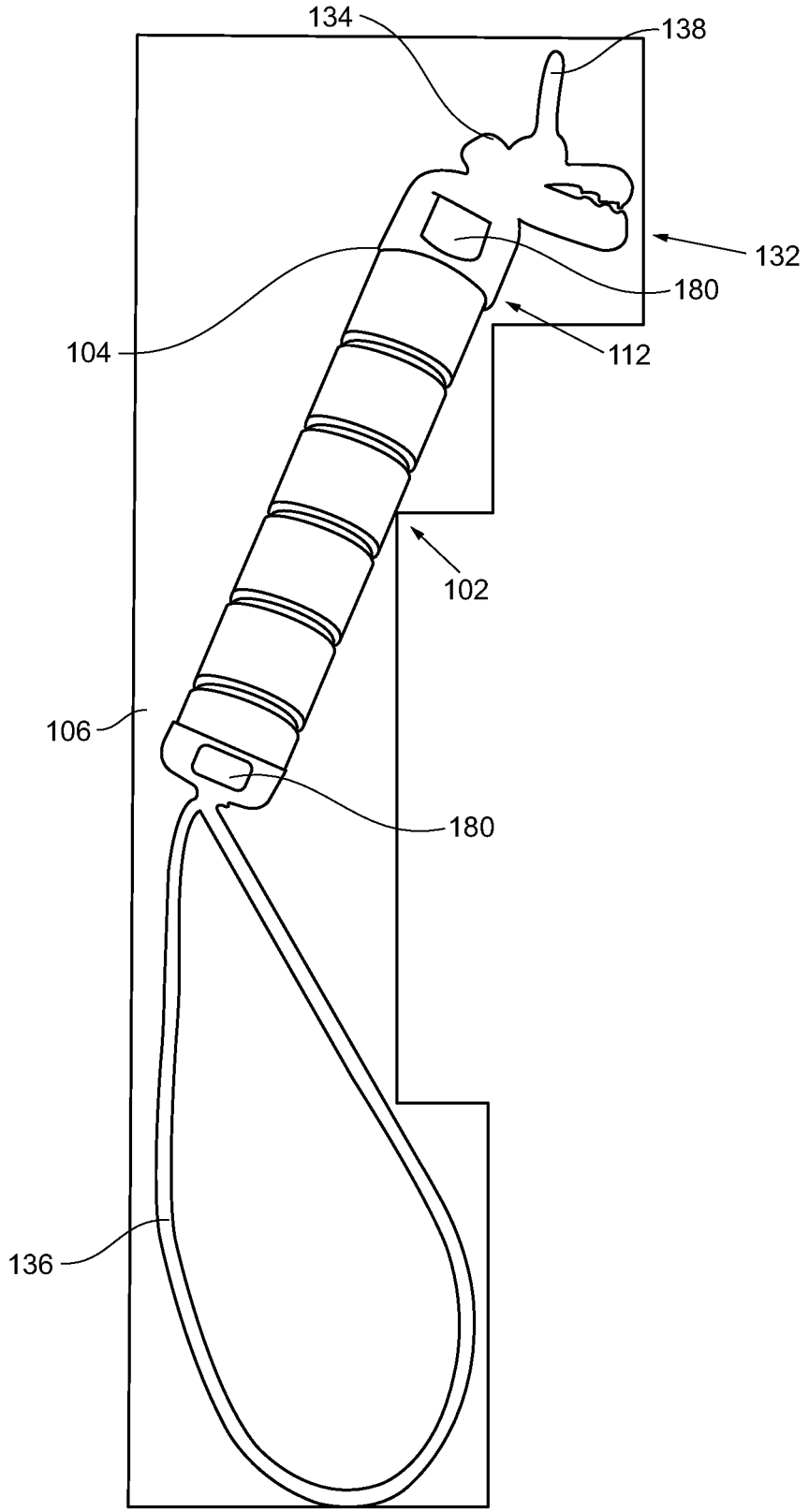
FIG. 2 illustrates a perspective view of the sound generation angular velocity-adjustable twirling device shown in FIG. 1 with an attached strap, in accordance with an embodiment of the present invention.

Turning now to FIG. 2, the device 100 comprises an outer sleeve 102 defined by a sleeve distal end 104, a sleeve proximal end 106, and a sleeve sidewall 108 that forms a generally elongated cavity. The outer sleeve 102 is generally stationary. The sleeve sidewall 108 provides a surface for gripping and manipulating the device 100. A torque 200 may be applied to the device 100 by twisting, rotating, shaking, or oscillating the outer sleeve 102.

In one embodiment, the outer sleeve 102 has a generally elongated, cylindrical shape. Though in other embodiments, the outer sleeve 102 may be rectangular. Suitable materials for the outer sleeve 102 may include, without limitation, polyurethane, polyethylene, polyvinyl chloride, a rigid polymer, a metal, a metal alloy, fiberglass, glass, wood, and cardboard.

Figure 3:
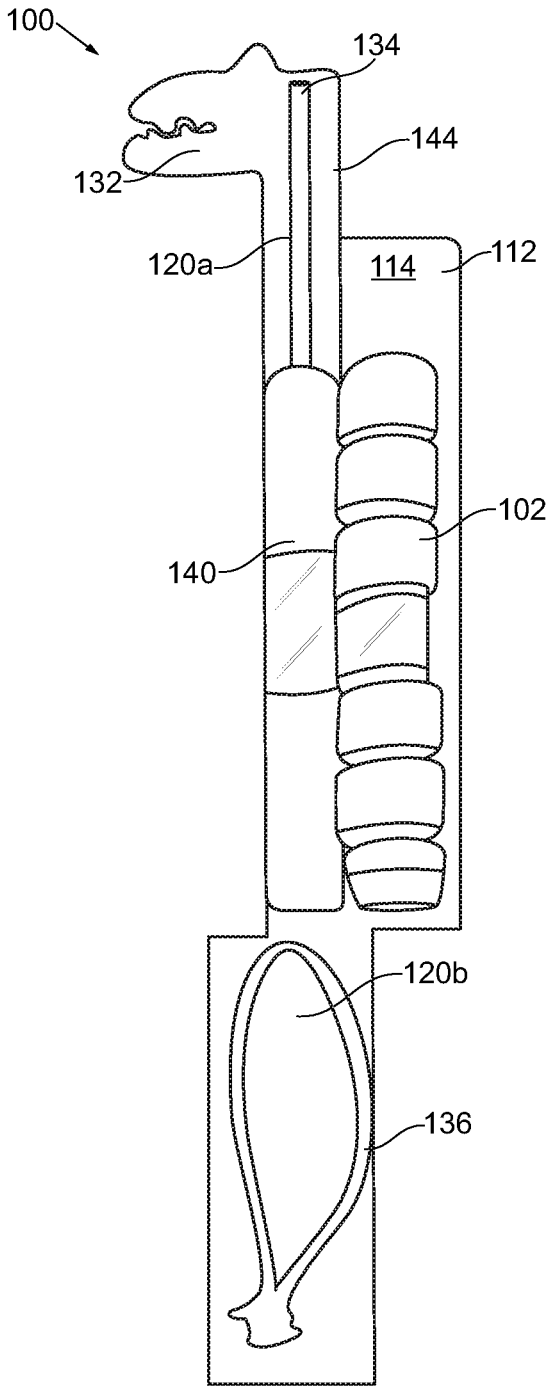
FIG. 3 illustrates a blow-up view of the sound generation angular velocity-adjustable twirling device shown in FIG. 1 separated into multiple components, in accordance with an embodiment of the present invention.

To enhance the grip on the outer sleeve 102, a textured panel 110 may position on the sleeve sidewall 108 of the outer sleeve 102. In some embodiments, the textured panel 110 may include a grip-textured surface, such as a surface having depressions that correlate to the positions of the fingers. The textured panel 110 may be colored, patterned, or contain indicia. The textured panel 110 may be fabricated from rubber or a resilient polymer that enhances gripping. FIG. 3 illustrates a perspective view of the center of the device 100 shown in FIG. 1 with the outer sleeve 102 removed from the rod 140.

In one embodiment, the outer sleeve 102 can be made of rubber, wherein the outer rubber sleeve 102 can be squeezed like a squeeze ball to expand and deflect under a certain pressure applied thereon. Therefore, the outer sleeve 102 can protect the textured panel 110 being deformed and further to absorb and disperse the pressure applied thereon.

In another embodiment, the device 100 further comprises a squeeze member 103 attached on a bottom end of the outer sleeve 102, wherein the squeeze member 103 may be squeezed in the hand and manipulated by the finger to exercise the muscles of the hands and further release the user's pressure. The squeeze member 103 can be designed as a football, a baseball, a soccer ball, a basketball or any athlete and political figures. It should be understood that the above-described designs are exemplary and any other designs can be adopted in various embodiments of this disclosure.

In yet another embodiment shown in FIG. 2, a strap 136 is disposed at the sleeve proximal end 106. The strap 136 may form a loop that wraps around the wrist of a user while twirling the device 100. The strap 136 may be fabricated from a flexible polymer, nylon, rubber, or rope fibers.

Looking now at FIG. 3, the device 100 further comprises a first axis 120*a* that is defined by a pair of the first axis ends 122*a*, 124*a*. The first axis 120*a* is disposed substantially in the cavity of the outer sleeve 102, extending along the length of the outer sleeve 102 in a parallel relationship. The first axis 120*a* passes through the aperture 118 in the cap top wall 116. The first axis 120*a*, is fixedly embedded in the rod 140. In one embodiment, the first axis 120*a* passes approximately 2¼" (even less or more) through the first-rod end 142*a*. In another embodiment, the first axis 120*a* extends from the rod about 35".

In some embodiments, the device 100 may further include a cap 112 that forms a terminus on the sleeve distal end 104 of the sleeve. The cap 112 is defined by a cap sidewall 114 and a cap top wall 116. The cap top wall 116 may be defined by an aperture 118. The cap 112 is configured to join with the sleeve distal end 104 with the cap sidewall 114 covering a portion of the sleeve sidewall 108. The cap 112 is also efficacious in maintaining the first axis 120*a* coaxially within the cavity of outer sleeve 102. The cap 112 also helps in securing the fastening mechanism 132 to the sleeve distal end 104, as discussed below.

Figure 4:
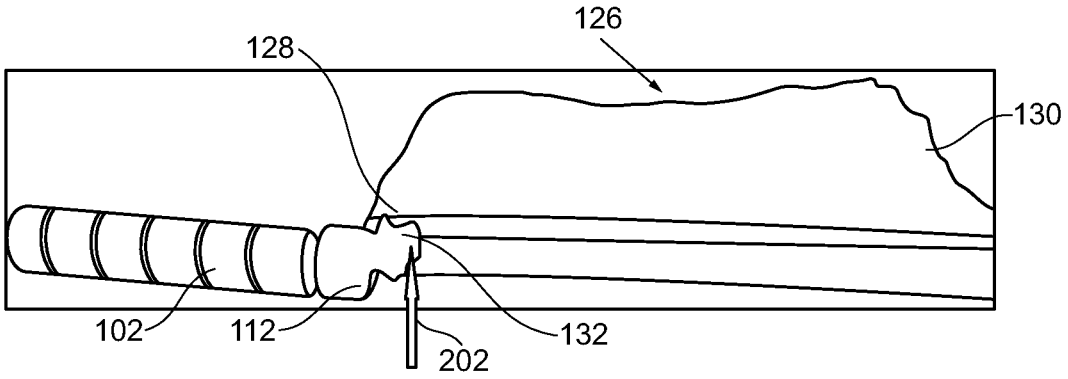
FIG. 4 illustrates a perspective view of a sound generation angular velocity-adjustable twirling device having a fastening mechanism attached to a central attachment point of a fabric-article, in accordance with an embodiment of the present invention.

As referenced in FIG. 4, the device 100 may include a fabric-article 126. The fabric-article 126 is a generally resilient panel defined by at least one central attachment point 128 and at least one peripheral attachment point 130. The fabric-article 126 is sufficiently resilient, so as to freely unfurl and twirl in correlation to rotation by the axis 120. Thus, as the torque 200 is applied in a first direction, the fabric-article 126 unfurls and twirls in a similar fashion.

The fabric-article 126 may include, without limitation, a towel, a flag, a pennant, a sock, a shirt, and an advertising medium. The fabric-article 126 may be formed of relatively thin, flexible material, with a sports team logo, player's name, a political symbol, etc., displayed thereon. Suitable materials for the fabric-article 126 may include, without limitation, natural fabrics, synthetic fabrics, plastic, rubber, woven materials, nonwoven materials, paper, and felt. The fabric-article 126 may also include advertising material, for example, sponsor information on the surface of the fabric-article 126.

The fabric-article 126 may be of any shape or dimension. According to one embodiment of the invention, the fabric-article 126 is approximately rectangular in shape with a length of approximately 21" and a height of approximately 8". The shape of the fabric-article 126 and images printed on the fabric-article 126 may coincide with the mascot or any other image associated with the user's favorite sports team or other entity using the fabric-article 126 for advertisement.

According to one embodiment of the invention, the fabric-article 126 may be made from printed felt which is die-cut to shape, for example in the shape of a triangle or sock. In another embodiment of the invention, two or more fabric-articles may be attached to the outer sleeve 102 through a single fastening mechanism 132, described below. In another embodiment, the fabric-article 126 may be manufactured as a dual die-cut terrycloth towel with printing on the surface and a surged edge.

In some embodiments, the device 100 may further include a fastening mechanism 132. In some embodiments, a pin 134 works to help fasten the fastening mechanism 132 to the first axis 120*a*. The pin 134 may extend axially with the outer sleeve 102 and the first axis 120*a*. The fastening mechanism 132 is configured to rotate freely about the first axis 120*a*, due in part to the first axis 120*a* having an exterior cross-sectional length 204 sized to correspond with an interior cross-sectional length 206 of the fastening mechanism 132. In some embodiments, a sleeve in the fastening mechanism 132 goes around the first axis end 122*a* of the first axis 120*a* to help rotate the fastening mechanism 132 about the first axis 120*a*. A clip fits around the sleeve to help with the rotation.

In one embodiment, the pin 134 can be any kinds of fasteners configured to fasten the fastening mechanism 132 on the cap 112, wherein the pin 134 also can be, not limited to, a polymer nail.

Through the application of torque 200 to the outer sleeve 102, the fastening mechanism 132 can be made to rotate about the first axis 120*a*, as shown in FIG. 1. The torque 200 may be applied by to the device 100 by twisting, rotating, shaking, or oscillating the outer sleeve 102. This causes the freely rotating fastening mechanism 132 to rotate in a first or second direction.

The fastening mechanism 132 also serves to detachably attach to the fabric-article 126 at the at least one central attachment point 128, the at least one peripheral attachment point 130, or both 128, 130. The at least one attachment point 128, 130 between the fastening mechanism 132 and the selected attachment point forms a center of gravity 202 at the fabric-article 126. The fastening mechanism 132 is configured to quickly attach and detach from the fabric-article 126 to enable varying the attachment points with the fabric-article 126.

In some embodiments, the fastening mechanism 132 may retain the fabric-article 126 in a generally vertical or horizontal orientation as the fabric-article 126 is unfurling and twirling. However, in one embodiment, the fastening mechanism 132 retains the fabric-article 126 in a generally 90° angle relative to the outer sleeve 102.

Looking again at FIG. 4, the fastening mechanism 132 may include a spring-based clip that is biased towards a closed position in which a pair of jaws close down on the selected attachment point 128, 130 at the fabric-article 126. The fastening mechanism 132 may include a lever 138 for manipulation to an open position. Applying pressure on the lever 138 displaces the jaws to an open position to release the fabric-article 126, and thereby enable repositioning of the fastening mechanism 132 to attach to a different central or peripheral attachment point 128, 130 on the fabric-article 126. In this manner, the center of gravity 202 on the fabric-article 126 may be changed to achieve the desired unfurling and twirling effect. The rate of unfurling and twirling by the fabric-article 126 is dependent on the center of gravity 202.

Figure 5:
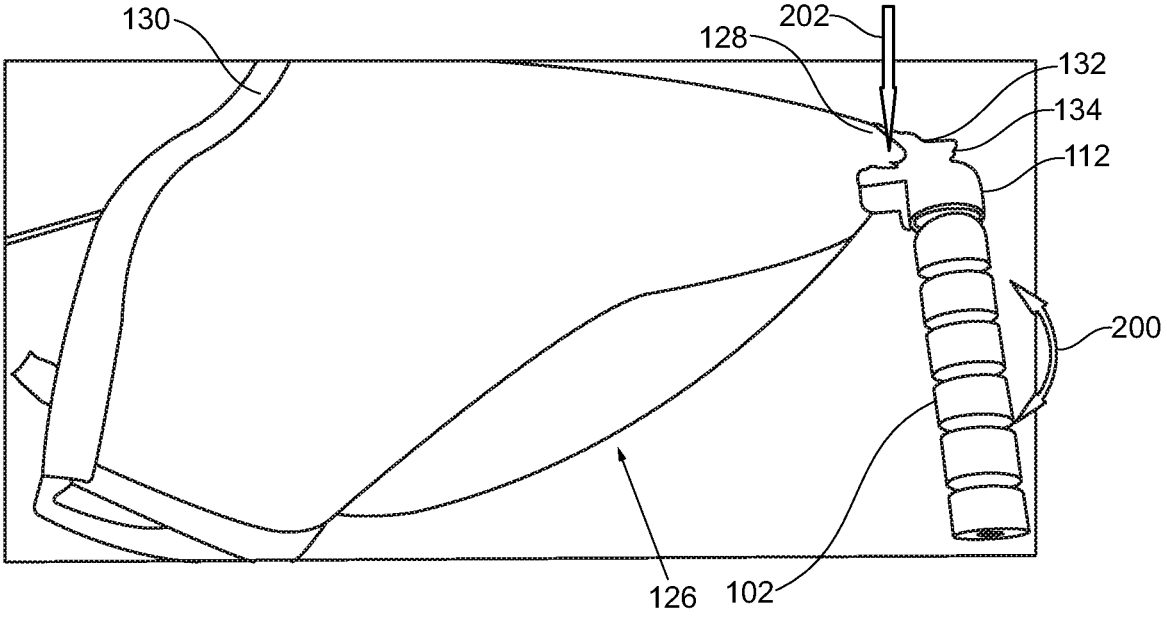
FIG. 5 illustrates a perspective view of the sound generation, the angular velocity-adjustable twirling device shown in FIG. 4 with torque applied to an outer sleeve to unfurl and twirl the fabric-article, and a central attachment point with a fabric-article creating a center of gravity at the central attachment point, in accordance with an embodiment of the present invention.
Figure 6:
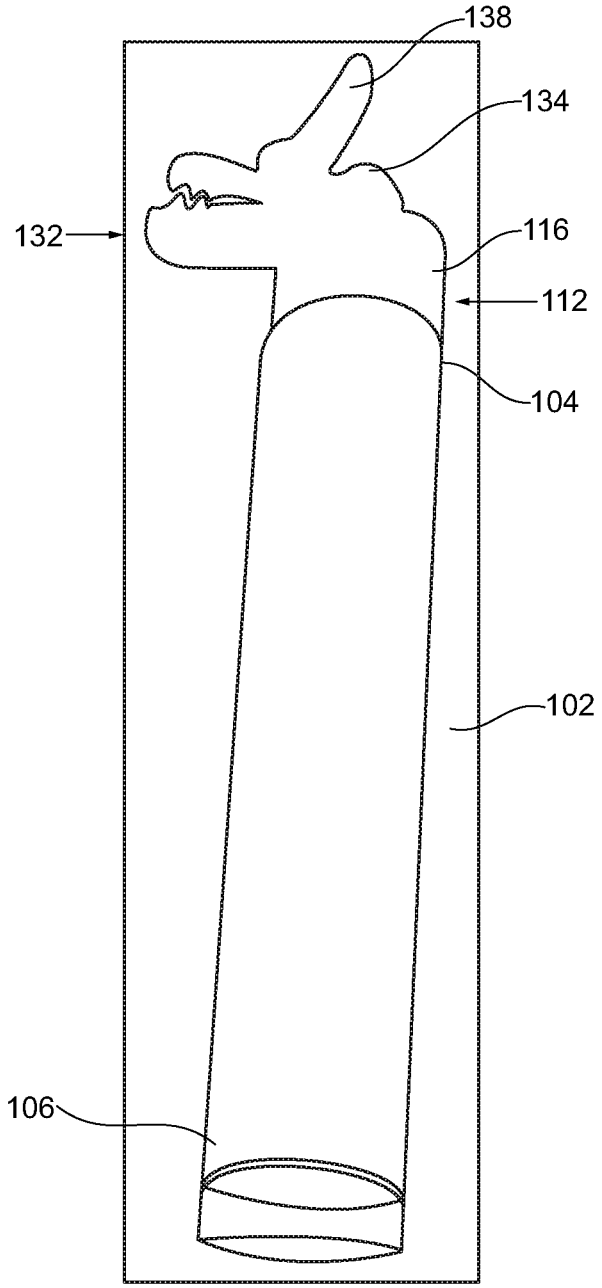
FIG. 6 illustrates a perspective view of sound generation, angular velocity-adjustable twirling device, showing a gear housing containing a first and second gear and axial support members disposed therein, in accordance with an embodiment of the present invention.

As shown in FIG. 5, the fastening mechanism 132 may be attached at multiple points on the fabric-article 126 between the central and peripheral attachment points 128, 130, so as to achieve the desired rate or angular velocity, and style of unfurling and twirling by the fabric-article 126. For example, clamping the jaws of the fastening mechanism 132 on the central attachment point 128 of the fabric-article 126 forms a more centrally located center of gravity 202 that puts the average location of the weight of the fabric-article 126 equidistant from the fastening mechanism 132. This may create a more uniform, and faster-twirling effect for the fabric-article 126.

For example, if the towel or article being twirled is placed at what is considered the centermost point of the towel where its weight is most likely distributed evenly to both sides of the clip or equidistant from the fastening mechanism, the weight distribution will be more uniform and will increase angular velocity and rotational speed at the center of gravity, not slow the twirling down. Having the fastening clip attached to the center of the towel or article will affect the aerodynamic relationship between the clip and the towel or article in a positive way.

Conversely, clamping the jaws of the fastening mechanism 132 to the peripheral attachment point 130 of the fabric-article 126 forms a more one-sided center of gravity 202 on the fabric-article 126. This puts the average location of the weight of the fabric-article 126 at a further distance the fastening mechanism 132. This may create a less uniform, and slower twirling effect, or angular velocity, as the weight of the distal portion of the fabric-article 126 increases the rotational momentum of the fabric-article 126.

This peripheral attachment point is less uniform and slows down the speed of the rotation. The further the attachment point of the fastening mechanism is from the center or the towel or article, the more off balanced the towel or article will be, thus leading to a weight distribution that is now unbalanced. This affects the aerodynamic relationship between the fastening clip and the towel or article in a negative way.

Figure 7:
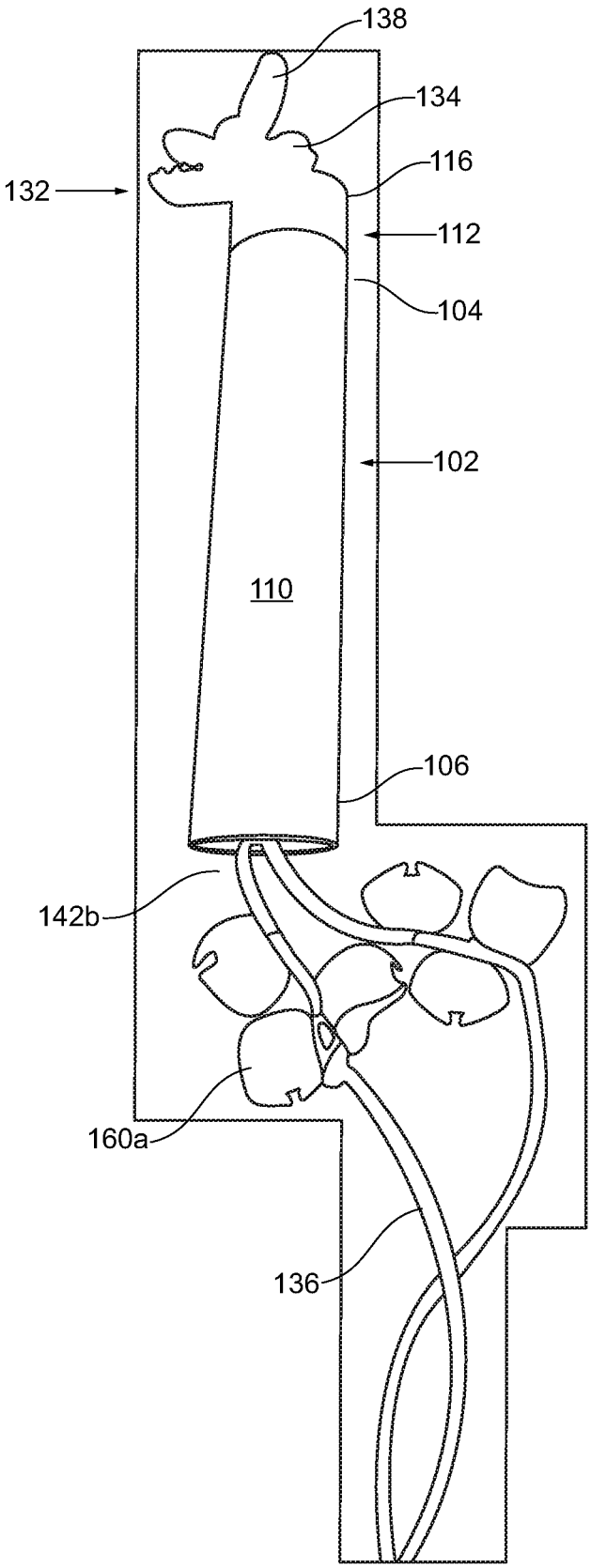
FIG. 7 illustrates a perspective view of the twirling device, showing a bell percussion instrument attached to the strap, in accordance with an embodiment of the present invention.

In this manner, an attendee at sporting events and rallies can demonstrate their affection or backing for a team, political figure, or performer by waving the device 100 with the attached fabric-article 126, which may include towels, flags, signs, and pennants with indicia such as slogans and colors symbolic of their partisanship. FIG. 7 illustrates a perspective view of the twirling device, showing a bell percussion instrument 160*a* attached to the strap 136. The device 100 generates sound through the use of the percussion instrument. The percussion instrument 160*a* attaches to the strap 136, or to the fastening mechanism 132, or both. FIG. 7 shows a bell percussion instrument attached to the strap. Applying torque to the outer sleeve causes the percussion instrument to generate sound pressure, as the motion of the device, overall, shakes the bells.

Further, the sound pressure generated by the percussion instrument is proportional to the angular velocity of the rotating fastening mechanism. Thus, as the angular velocity of the fastening mechanism 132 and fabric-article 126 increases. This creates greater instability on the device 100, which shakes the bells 160*a* to create greater sound pressure therefrom.

Figure 8:
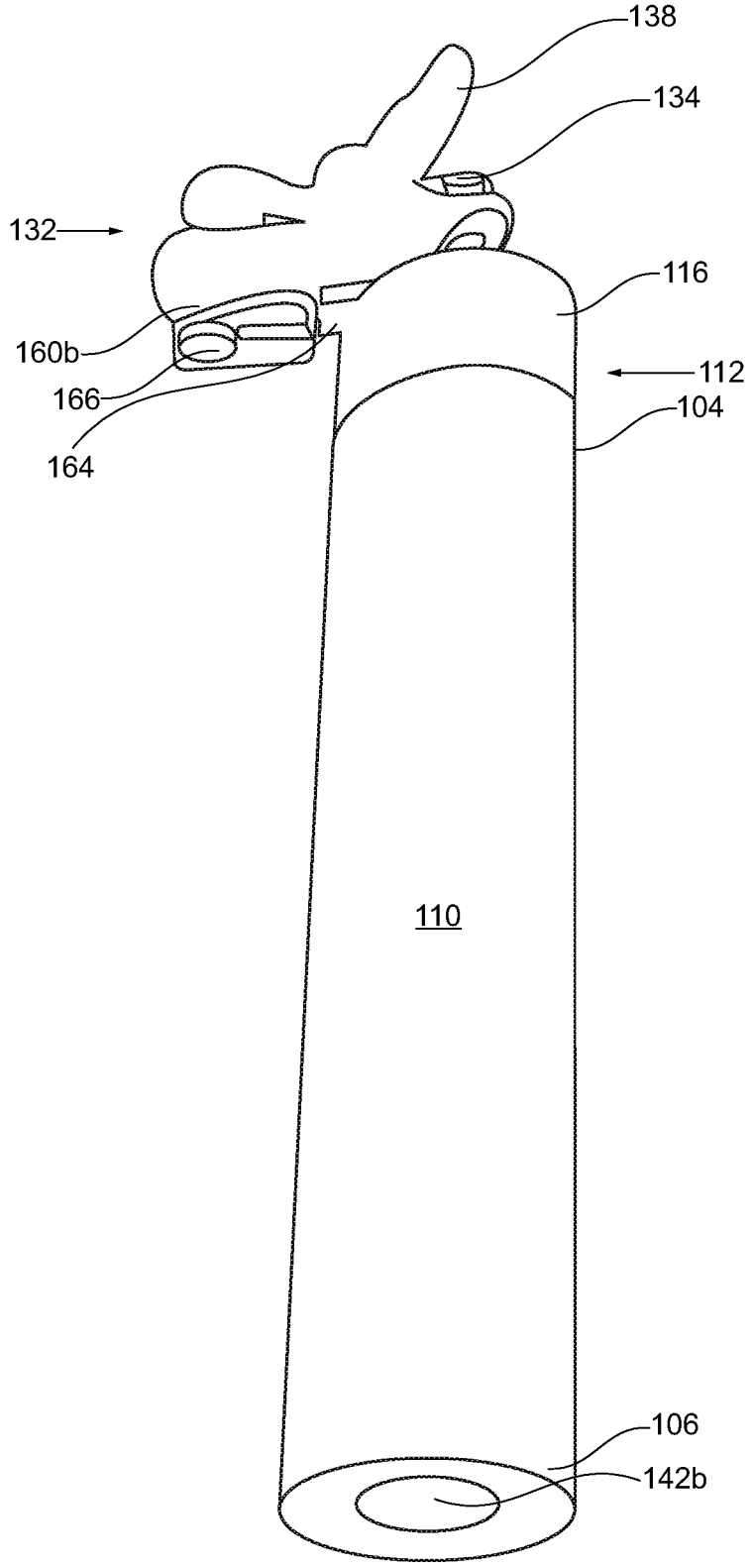
FIG. 8 illustrates a perspective view of the twirling device, showing a rattle percussion instrument attached to the fastening mechanism, in accordance with an embodiment of the present invention.

FIG. 8 illustrates a perspective view of the twirling device 100, showing a rattler percussion instrument 160*b* attached to the fastening mechanism 132. The rattler is a second type of percussion instrument. Though the device 100 may utilize other percussion instruments and general noise-making members, include, without limitation, bones, a drum, clap sticks, cymbals, a gong, a maraca, a whistle, a woodblock, and a zill.

In one non-limiting embodiment, the rattler 160*b* is configured to arrange with a rattling tongue 164, wherein the rattler 160*b* may be a box, but not be limited to any shapes or materials. In this manner, the torque applies to the sleeve and the fastening mechanism 132 may be rotated with respect to a fastener 166. In one embodiment, a rattling tongue 164 secured with a fastener 166 arranged on the cap top wall 116 to support the rattler 160*b* at or near the top of the fastening mechanism 132. Thus, the rattler 160*b* and the bell 160*a* may work independently of each other, or simultaneously together to generate sound pressure. In any case, the amount of force and rotation applied to the device 100, overall, dictates the level of sound pressure generated by the percussion instrument 160*a*, 160*b*. It is worth to mention that the rattler 160*b* can be a wooden box or a plastic box, and the rattling tongue 164 also can be made of plastic or wood. The rattler 160*b* can be shaped as a cylindrical shape, but it is not limited to the cylindrical shape.

In one aspect, the rattler 160*b*, the rattling tongue 164, and the fastening mechanism 132 are a one-piece structure. In addition, the rattler 160*b*, the rattling tongue 164, and the fastening mechanism 132 are three separate pieces. In another aspect, the rattler 160*b*, the rattling tongue 164, and the fastening mechanism 132 are integrated. It should be understood that the above-described configuration is exemplary and any other configuration can be adopted in various embodiments of the disclosure.

Figure 9:
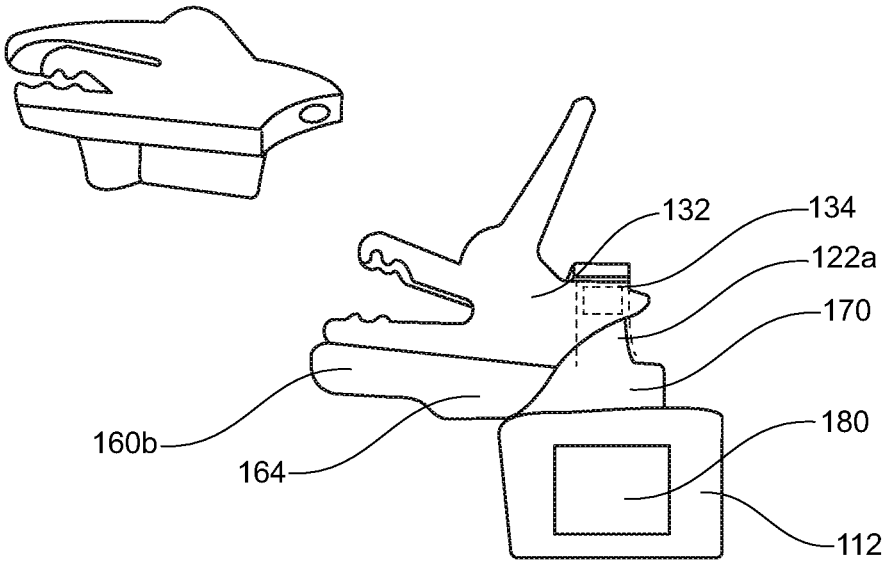
FIG. 9 is a sectional view of the fastening mechanism in accordance with an embodiment of the present invention.

As shown in FIG. 9, the device 100 further comprises a second gear 170 fixedly attached on the first axis end 122*a* of the first axis 120*a*. Accordingly, the fastening mechanism 132 can be configured to rotate with respect to the pin 134, and the rattling tongue 164 can be fixedly attached underneath the fastening mechanism 132 by the rattler 160*b*. In this way, the rattling tongue 164 can be slightly contacted with the second gear 170 to generate the sound pressure when the fastening mechanism 132 is rotated with respect to the pin 134.

Figure 10:
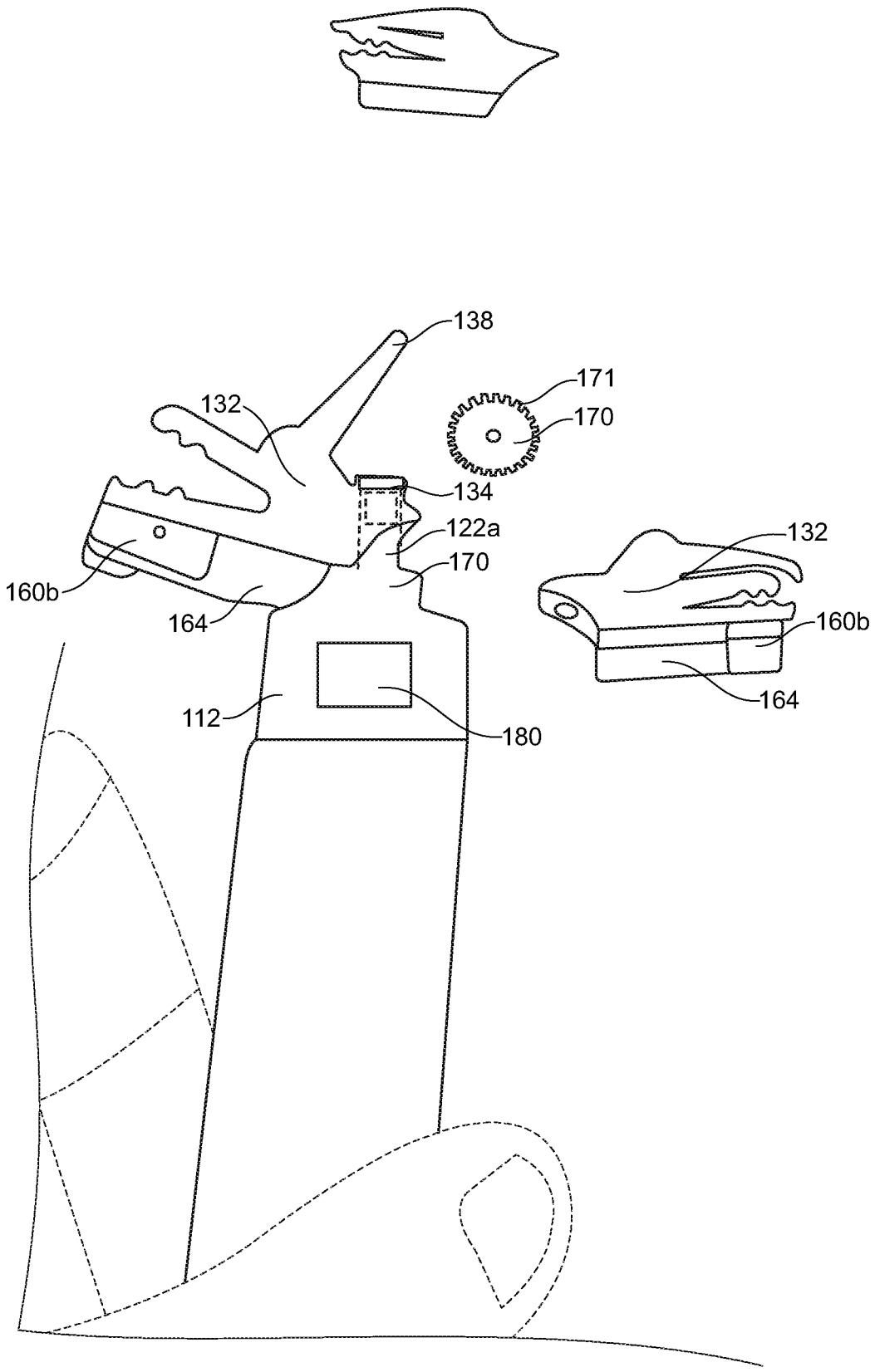
FIG. 10 is an exploded view of the twirling device in accordance with an embodiment of the present invention.

As shown in FIG. 10, the second gear 170 comprises a plurality of teeth 171 arranged around a periphery of the second gear 170, wherein the rattling tongue 164 can engage with the teeth 171 to generate the rattling sound when the fastening mechanism 132 is rotated with respect to the pin 134. In one aspect, the number of the teeth 171 formed on the second gear 170 is predetermined, wherein the number of the teeth 171 can be one or as many as hundreds of teeth 171 formed on the second gear 170. In addition, sizes of the teeth 171 formed on the second gear 170 are also predetermined. The sizes and number of the teeth 171 formed on the second gear 170 define the types and strength of the sound pressure generated between the rattling tongue 164 and the teeth 171 of the second gear 170. In one embodiment, the second gear 170 can be shaped as a cogwheel having at least one gear engaged with other gears, wherein the cogwheel can be made of wood or plastic. Accordingly, the device 100 can be designed to have a transparent exterior. In other words, the spring-based clip 138 and the textured panel 110 can comprise transparent exteriors. In one embodiment, the device 100 further comprises an illumination member 180 disposed inside the cap 112 to provide the illumination effect, wherein the illumination member 180 may be an LED light or Neon light.

It should be understood that the above-described types of illumination member 180 are exemplary and any other types of illumination member 180 can be adopted in various embodiments of this disclosure.

In one embodiment, the outer sleeve 102 can be transparent, and the illumination member 180 can be disposed inside the outer sleeve 102 to perform the illuminating effects. Alternatively, the textured panel 110 can be made of wood materials without having the outer sleeve 102. It should be understood that the above-described materials of textured panel 110 are exemplary and any other materials can be adopted in various embodiments of this disclosure.

In another embodiment, the illumination member 180 may be disposed inside the fastening mechanism 132. In the other hand, the fastening mechanism 132 may be transparent to allow the illuminating effects generated from the illumination member 180 for representing through the fastening mechanism 132.

Figure 11:
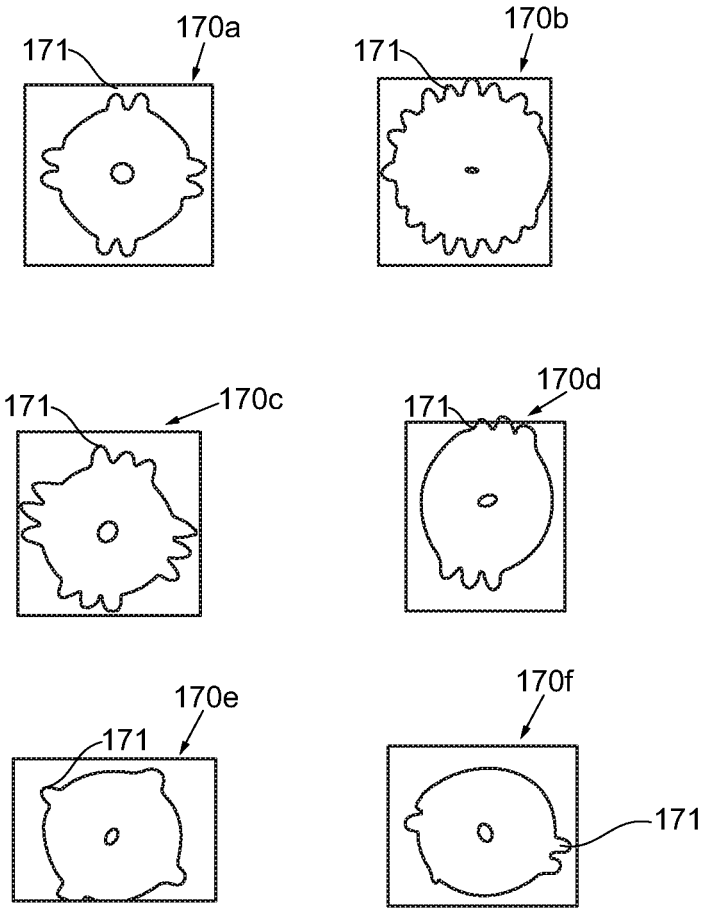

FIG. 11 illustrates a perspective view of sound generation, angular velocity-adjustable twirling device, showing a gear housing containing a second gear and axial support members. As discussed above, the device 100 generates sound through that the second gear 170 joins with the rattling tongue 164.

The second gears 170 may include disc-shaped gears having teeth that mesh together. FIG. 11 illustrates a top view of a various type of second gears 107*a-f* having irregularly shaped and arranged teeth 171 around the periphery of the gears. As shown, the teeth 171 may be defined, but not limited to, by irregular shapes that generate sound pressure when rotationally engaging each other. For example, in one embodiment, the second gears can have four pairs of equidistant rounded teeth.

In another embodiment, the second gear can have uniformly dispersed shorter, yet sharper teeth around its periphery.

The second gear 170 can be shaped as a cogwheel having at least one gear engaged with the rattler 160*b*, wherein the cogwheel can be made of wood or plastic. The second gear 170 is made of flexible material, such as polymer or wood. The material is not limited to polymer or wood. The spring-based clip 138 is biased towards a closed position in which a pair of jaws close down on the selected attachment point at the fabric-article.

The sound pressure may include a clicking sound or a whirling sound, but not be limited to the above-mentioned sound effects. The material composition of the second gears may include a plastic that dictates the type and decibel of the sound pressure, but not be limited to the above-mentioned materials. In other words, the size and width of the teeth formed on the second gears 170*a-f* respectively also can be configured to dictate the type and decibel of the sound pressure. A first set of teeth for their respective second gears 170*a-f* shows a second gear 170*a* having four equidistant pairs of first teeth 171. In another embodiment, the second gear 171*b* have a uniform arrangement of first teeth 171 along the entire periphery of the second gear 171*b*.

In yet another embodiment, the second gear 170*c* comprises four sets of teeth having three equidistant teeth 171 spacedly arranged on the periphery of the second gear 170*c*.

In still yet another embodiment, the second gear 170*c* comprises two sets of teeth having three equidistant teeth 171 spacedly arranged on the periphery of the second gear 170*c*, wherein the two sets of teeth are arranged opposite on the periphery of the second gear 170*c*.

In still yet another embodiment, the second gear 170*c* comprises four sets of teeth having one teeth 171 spacedly arranged on the periphery of the second gear 170*c*.

In still yet another embodiment, the second gear 170*c* comprises two sets of teeth having two equidistant teeth 171 spacedly arranged on the periphery of the second gear 170*c*, wherein the two sets of teeth are arranged opposite on the periphery of the second gear 170*c*.

It should be understood that the above-described configuration of the teeth 171 of the second gear 170 are exemplary and any other configuration of the teeth on the second gear 170 can be adopted in various embodiments of the disclosure.

Accordingly, the material composition of the second gear 170 and the rattling tongue 164 dictates the type and decibel of the generated sound pressure. For example, a metal first and second gear generates a more hollow sound than a plastic or wood gear. The size of the gears is also instrumental in determining the sound pressure. For example, a larger gear generates more sound pressure than a smaller gear. Thus, it is a unique element of the present invention that the size, material, shape, and irregular configuration of the teeth dictate the decibel and type of sound pressure generated by the engagement between the second gear 170 and the rattling tongue 164.

Thus, applying torque to the outer sleeve 102, as described above to unfurl and twirl the fabric-article 126, causes the second gear to rotate about the first axis 120*a*. And the sound pressure generated by meshing the first teeth 171 on the second gear 170 with the rattling tongue 164. Thus, increasing the angular velocity of the fastening mechanism 132 naturally increases the sound pressure, so different kinds of sound effects generates based on the configuration of the teeth 171 of the second gear 170 and the angular velocity applied on the fastening mechanism 132. In one aspect, the length and thickness of the rattling tongue 164 are non-limited. It should be understood that any length and thickness of the rattling tongue 164 can be adopted to in various of embodiments of the disclosure.

In another embodiment, the illumination member 180 can be disposed inside a bottom portion of the rod 140 or arranged with the spring-based clip 138. In another aspect, the illumination member 180 can be arranged in the spring-based clip 138.

In another embodiment, the illumination member 180 can be a LED light, and can be set inside the fastening mechanism 132 or arranged on the surface of the textured panel 110, the spring-based clip 138 and/or the pin 134, but not limited to those locations.

Accordingly, the illumination member 180 can be a LED light, wherein the illumination member 180 can be controlled by an outside device via Bluetooth and/or Wi-Fi. In other words, the illumination member 180 can be controlled by the personal cellphone or remote controller to adjust the strength of the illumination effect and turn on/down the illumination effect. Furthermore, the twirling device 100 further comprises a plurality of speakers 190 selectively arranged inside the rod 140 or the outer sleeve 102, wherein the speaker 190 wirelessly connected to the outside device via Bluetooth and/or Wi-Fi. In other words, the speaker 190 can be controlled by the outside device and play the music stored in the outside device.

Figure 12:
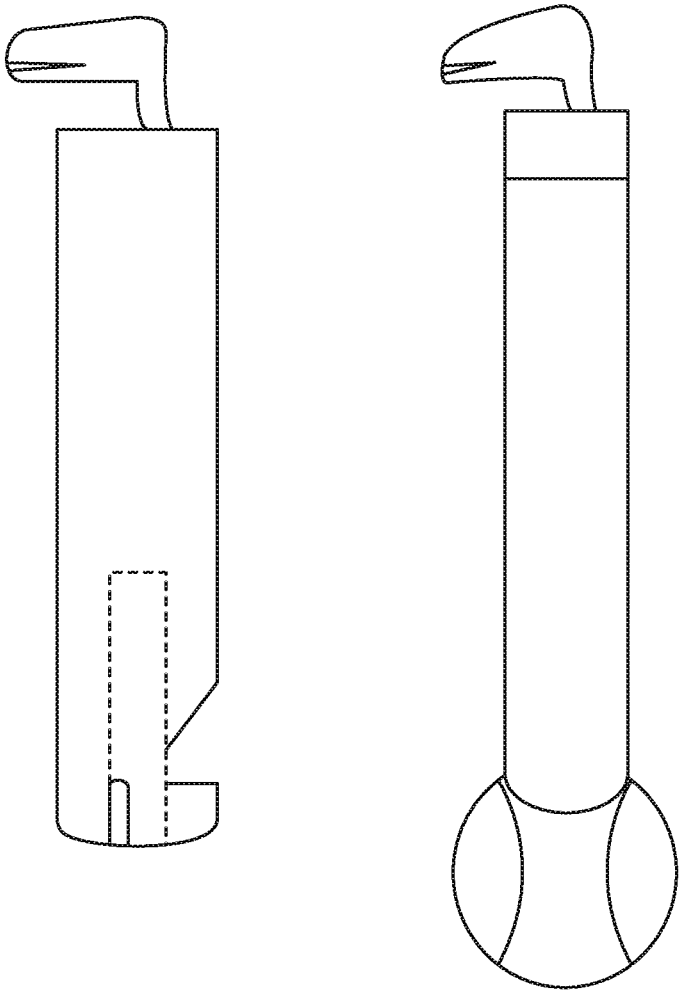
FIG. 12 is a perspective view of the sound generation angular velocity-adjustable twirling device, in accordance with an embodiment of the present invention, illustrating an air horn being embedded thereon.

FIG. 12 generally depicts the basic architecture of an air horn in accordance with the one of the disclosed embodiment. The device 100 may further include an air horn attached on the rod 140, wherein the air horn is adopted to compress air to generate air horn sound effect.

Figure 13:
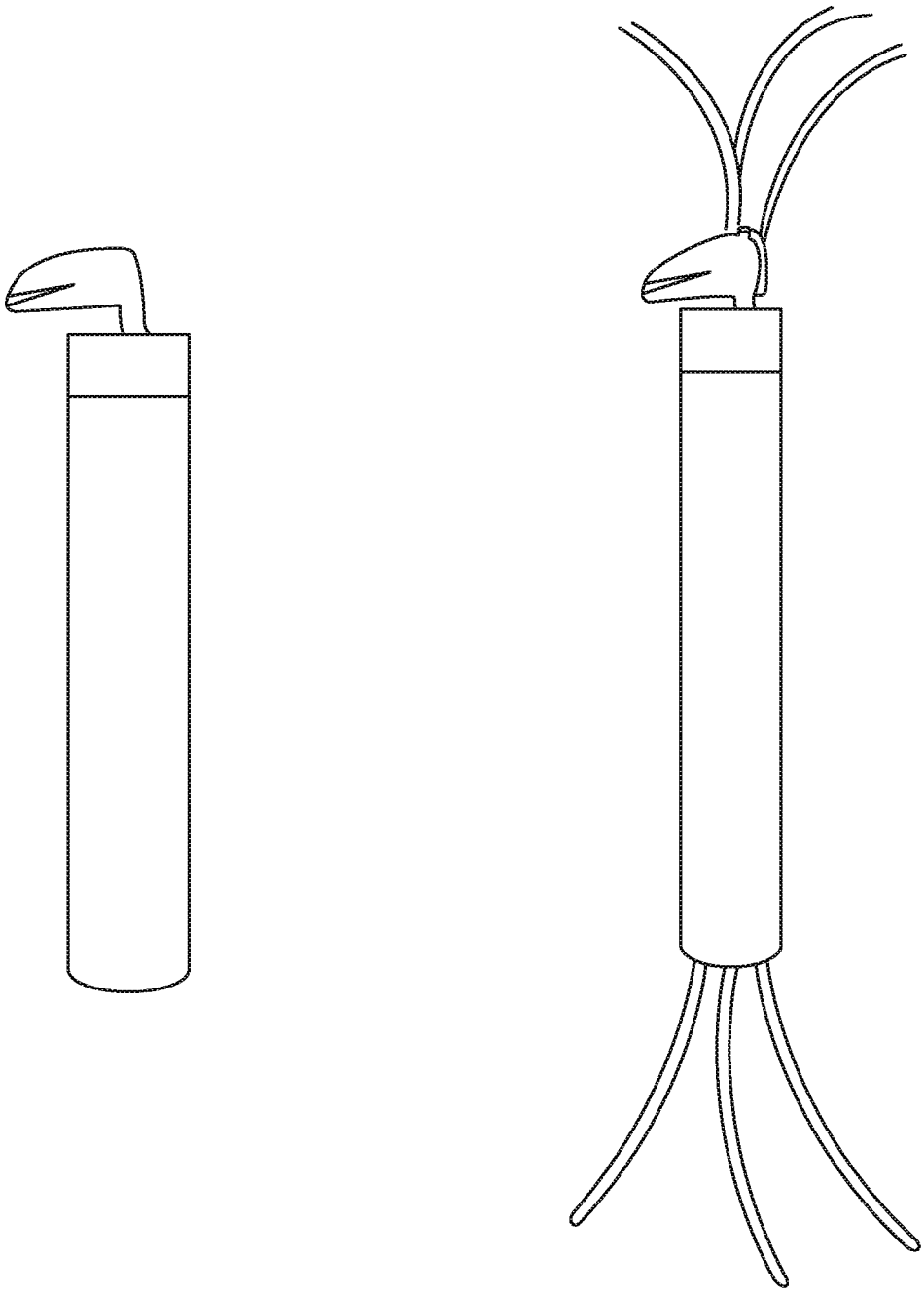
FIG. 13 is a perspective view of the sound generation angular velocity-adjustable twirling device, in accordance with an embodiment of the present invention, illustrating a plurality of lighting tubes attached on a top or a bottom portion of the sound generation device.

FIG. 13 generally depicts the basic architecture of a plurality of lighted tubes attached on a top portion of the device 100 or a bottom portion of the device 100, wherein the lighted tubes may generate various light effects. In one embodiment, the plurality of lighted tubes may be arranged on the pin 134 to provide the light effects.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A sound generation angular velocity-adjustable twirling device, the device comprising:

a rod defined by a first rod end and a second rod end;

an outer sleeve defined by a sleeve distal end, a sleeve proximal end, and a sleeve sidewall forming a cavity, the outer sleeve configured to at least partially encapsulate the rod;

a textured panel disposed on the sleeve sidewall of the outer sleeve;

a cap defined by a cap sidewall and a cap top wall forming an aperture, the cap configured to join with the sleeve distal end;

a first axis, the first axis disposed in the cavity of the outer sleeve, the first axis configured to penetrate the first rod end;

a fabric-article defined by at least one central attachment point and at least one peripheral attachment point, the fabric-article being configured to be resilient, so as to freely unfurl and twirl in correlation to rotation;

a fastening mechanism operatively joined with the first axis, the fastening mechanism configured to rotate freely about the first axis, due in part to the first axis having an exterior cross-sectional length sized to correspond with an interior cross-sectional length of the fastening mechanism, whereby applying torque to the outer sleeve causes the fastening mechanism to rotate about the first axis, the fastening mechanism further configured to detachably attach to the fabric-article at the at least one central attachment point, the at least one peripheral attachment point, or both, whereby the at least one central and peripheral attachment points between the fastening mechanism and the selected attachment point form a center of gravity for the fabric-article, whereby the rate of unfurling and twirling by the fabric-article is dependent on the center of gravity;

a second gear fixedly arranged on the first axis; and a rattler fixedly arranged underneath the fastening mechanism and having a rattling tongue horizontally extended from the rattler;

wherein one end of the rattling tongue is fixed with the rattler and the other end of the rattling tongue engages with the second gear.

2. The device of claim 1, further comprising a tube disposed to receive the first axis.

3. The device of claim 1, wherein the outer sleeve has a generally elongated, cylindrical shape.

4. The device of claim 1, wherein the first axis passes through the aperture in the cap top wall.

5. The device of claim 1, further comprising a pin.

6. The device of claim 4, wherein the pin is configured to at least partially fasten the fastening mechanism to the first axis.

7. The device of claim 1, wherein the fabric-article includes at least one of the following: a towel, a flag, a pennant, a sock, a shirt, and an advertising medium.

8. The device of claim 1, wherein the fastening mechanism is configured to retain the fabric-article in a generally 90-degree angle relative to the outer sleeve.

9. The device of claim 1, wherein the fastening mechanism is a spring-based clip.

10. The device of claim 1, further comprising a strap.

11. The device of claim 9, wherein the strap is configured to join with the second rod end and the sleeve proximal end.

12. The device of claim 10, wherein the second axis helps fasten the strap to the second rod end.

13. The device of claim 10, wherein the strap is fastened by a staple.

14. The device of claim 11, further comprising at least one percussion instrument, the percussion instrument attached to the strap, or to the fastening mechanism, or both, wherein applying torque to the outer sleeve causes the percussion instrument to generate sound pressure.

15. The device of claim 12, wherein the percussion instrument comprises a bell and a rattle.

16. A sound generation angular velocity-adjustable twirling device, the device comprising:

a rod defined by a first rod end and a second rod end;

an outer sleeve defined by a sleeve distal end, a sleeve proximal end, and a sleeve sidewall forming a cavity;

a textured panel disposed on the sleeve sidewall of the outer sleeve;

a cap defined by a cap sidewall and a cap top wall forming an aperture, the cap configured to join with the sleeve distal end;

a first axis defined by a pair of first axis ends, the first axis disposed in the cavity of the outer sleeve, the first axis configured to at least partially penetrate the first rod end;

a tube disposed to receive the first axis;

a fastening mechanism joined with the first axis, the fastening mechanism configured to rotate about the first axis, due in part to the first axis having an exterior cross-sectional length sized to correspond with an interior cross-sectional length of the fastening mechanism, whereby applying torque to the outer sleeve causes the fastening mechanism to rotate;

a pin configured to at least partially fasten the fastening mechanism to the first axis;

a strap configured to join with the second rod end and the sleeve proximal end of the outer sleeve;

a second gear fixedly arranged on the first axis; and a rattler fixedly arranged underneath the fastening mechanism and having a rattling tongue horizontally extended from the rattler;

wherein one end of the rattling tongue is fixed with the rattler and the other end of the rattling tongue engages with the second gear;

at least one percussion instrument, the percussion instrument attached to the strap, or to the fastening mechanism, or both, wherein applying torque to the outer sleeve causes the percussion instrument to generate sound pressure, wherein the sound pressure generated by the percussion instrument is proportional to the amount of torque applied to the sleeve.

17. The device of claim 16, wherein the strap is fastened by a staple.

18. The device of claim 16, wherein the fastening mechanism comprises a spring-based clip.

19. The device of claim 16, wherein the gears have a disc-shape.

* * * * *